US008011202B2

(12) United States Patent
Kim et al.

(10) Patent No.: US 8,011,202 B2
(45) Date of Patent: Sep. 6, 2011

(54) AUGER IN ICE BIN AND REFRIGERATING MACHINE HAVING THE SAME

(75) Inventors: Yong-Su Kim, Seoul (KR); Seong-Jae Kim, Seoul (KR); Nam-Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 685 days.

(21) Appl. No.: 12/112,018

(22) Filed: Apr. 30, 2008

(65) Prior Publication Data

US 2008/0295536 A1 Dec. 4, 2008

(30) Foreign Application Priority Data

May 28, 2007 (KR) ..... 10-2007-0051686

(51) Int. Cl.
*F25C 5/18* (2006.01)

(52) U.S. Cl. ..... 62/344; 62/354

(58) Field of Classification Search ..... 62/320, 62/344, 354, 135, 233; 222/146.6; 220/592.02
See application file for complete search history.

(56) References Cited

U.S. PATENT DOCUMENTS

| | | | | |
|---|---|---|---|---|
| 4,627,556 | A * | 12/1986 | Brooks | 222/240 |
| 6,952,936 | B2 | 10/2005 | Sannasi | |
| 2004/0163405 | A1 * | 8/2004 | Jung | 62/344 |
| 2006/0202072 | A1 * | 9/2006 | Lee et al. | 241/101.2 |

FOREIGN PATENT DOCUMENTS

| | | |
|---|---|---|
| JP | 2005-257159 | 9/2005 |
| KR | 10-2006-0074189 | 7/2006 |
| KR | 10-2006-0132194 | 12/2006 |

OTHER PUBLICATIONS

International Search Reported and Written Opinion, dated Sep. 23, 2008 for Application No. PCT/KR2008/002245, 10 pages.

* cited by examiner

*Primary Examiner* — Mohammad Ali
(74) *Attorney, Agent, or Firm* — Fish & Richardson P.C.

(57) ABSTRACT

Disclosed is the auger in an ice bin mounted in a refrigerator, and the like. The auger in the ice bin is configured to rotate an auger having spiral-shaped transfer blades and to dispose ice in each space between the transfer blades of the auger for transfer. Accordingly, a certain amount of ice can always be discharged without simultaneously discharging a great amount of ice, and a user may select the number of ice, thus to diversity functions of an ice dispenser. In addition, since the auger is made of a flexible material, the ice can be prevented from being crushed during transfer, thereby enhancing the reliability of the ice dispenser.

19 Claims, 9 Drawing Sheets

AUGER IN ICE BIN AND REFRIGERATING MACHINE HAVING THE SAME

The present application claims priority to Korean Application No. 10-2007-0051686 filed in Korea on May 28, 2007, which is herein expressly incorporated by reference in its entirety.

BACKGROUND

1. Field

This disclosure relates to an auger in an ice bin, which is provided in a refrigerator or water purifier having an ice-making machine and is capable of discharging ice pieces incrementally, e.g., one by one.

2. Background Art

In general, an ice-making machine is a device that makes ice, and that is mounted in a refrigerator, a water purifier, etc. Many attempts have recently been made to diversify and improve the quality of offered refrigerating machines, such as a refrigerator, a water purifier, etc.

Refrigerating machines that include ice-making devices may be further provided with an auger in an ice bin, which is capable of discharging ice made by an ice-making machine without opening a refrigerator door. The auger in the ice bin is generally configured to store a large quantity of ice pieces in a storage chamber and to discharge a certain amount of ice when a user selects an option to discharge ice pieces.

In refrigerator machines having the aforementioned augers within their ice bins, the ice pieces stored in the storage chamber may be stuck together, making it difficult to discharge ice pieces smoothly or preventing smooth discharge altogether. Moreover, when the ice pieces are discharged, the ice pieces may be crushed, thereby varying the amount of ice being discharged, and potentially allowing for a great amount of ice to be discharged at one time.

SUMMARY

As embodied and broadly described herein, there is provided an auger in an ice bin which can regularly discharge ice pieces one by one without being crushed, and a refrigerating machine having the same.

As embodied and broadly described herein, there is also provided an auger in an ice bin having an auger, which is provided with at least two spiral-shaped transfer blades in a circumferential direction and is rotated with ice disposed in each space between the transfer blades for transferring the ice.

In one aspect, an auger assembly in an ice bin of an ice maker having an ice making device configured to generate ice cubes of a full size, includes an auger having a rotational axis about which the auger is rotatable; and spiral-shaped transfer blades extending in a circumferential direction along the rotational axis of the auger, two adjacent of the spiral-shaped transfer blades being separated by a distance and shaped to cooperatively define a space there between that is sufficiently sized to accommodate an ice cube of full size from within the ice bin, the transfer blades being configured to rotate with auger rotation about the rotational axis of the auger and to impart force against the ice cube accommodated by the two adjacent spiral-shaped transfer blades to transfer the ice.

Implementations may include one or more of the following features. For example, the transfer blades may include a shaft portion coupled to a rotation shaft of a motor, a guide portion protruding from an outer circumferential surface of the shaft portion in a radial direction and spirally configured in a shaft direction so as to guide ice, and a receiving portion extending circumferentially at an angle from an outer edge of the guide portion in a radial direction so as to secure ice. A disk-shaped reinforcing portion may be connected to an end of each guide portion and a shaft of the auger. The auger may include a flexible material.

In another aspect, an auger assembly in an ice bin of an ice maker having an ice making device configured to generate ice cubes of a full size includes: a casing defining an ice storage chamber at an opened upper surface thereof, a discharge opening at a lower surface thereof so as to discharge ice, and a communication hole disposed at a side surface of a transfer chamber and positioned between the ice storage chamber and the discharge opening so as to pass ice; a motor configured to generate a rotation force; and an auger rotatably mounted inside the casing and configured to rotate about a rotational axis based on rotation force generated by the motor; at least two spiral-shaped transfer blades extending in a circumferential direction along the rotational axis of the auger, two adjacent of the spiral-shaped transfer blades being separated by a distance and shaped to cooperatively define a space there between that is sufficiently sized to accommodate an ice cube of full size from within the ice storage chamber, the transfer blades being configured to rotate with auger rotation about the rotational axis of the auger and to impart force against the ice cube accommodated by the two adjacent spiral-shaped transfer blades to transfer the ice to the communication hole of the casing.

Implementations of this aspect may include one or more of the following features. For example, an ice cutting portion may be disposed between the ice storage chamber and the transfer chamber of the casing and configured to at least partially cut ice disposed within the auger when the auger is rotated. An ice guide unit may be positioned closer to the communication hole than the ice chamber and it may have a step structure that interfaces ice cubes that are accommodated and being moved by the spiral-shaped transfer blades, to inhibit rotational movement of those ice cubes so as to guide the ice cubes disposed in the auger to the communication hole. The communication hole of the casing may have a shape that is consistent with a shape of the space defined between the transfer blades of the auger when positioned to accommodate an ice cube of full size. The auger may include a flexible material so as to prevent ice from being crushed.

The auger may include a shaft portion coupled to the rotation shaft of the motor, and a plurality of transfer blades each may spirally protrude from an outer circumferential surface of the shaft portion in a circumferential direction with a certain distance there between so as to guide ice. The transfer blade may include a receiving portion extending circumferentially at an angle from an outer edge of the transfer blades in a circumferential direction.

A disk-shaped reinforcing portion may be connected to an end of each transfer blade. The space defined between the transfer blades may be consistent in size with a size of an individual ice cube of full size that is stored in the ice storage chamber. A grind chamber may have a through-hole at a lower surface thereof positioned outside the communication hole of the casing so as to guide ice to the discharge opening. An ice grinder may be included in the grind chamber and configured to discharge ice or to grind ice for discharge. An assembly may enable the motor to operate the ice grinder in addition to the auger. The ice grinder may include rotary blades and fixed blades, with the ice grinder being configured to grind ice that is disposing between the rotary blades and the fixed blades. The rotary blades and the fixed blades may be positioned within the ice grinder in an alternating manner.

A shutter may be positioned at a through-hole and adjustably configured to control the size of ice discharged through the through-hole. The shutter may be configured with a first end that is fixed relative to a location of the ice grinder and a second end that moves relative to the first end to effect selection of size for ice cubes discharged as between at least ice cubes of full size and ice cubes of a size other than full size, the shutter being oriented relative to the ice grinder, whereby the shutter is at least partially closed when the ice grinder is operated to produce ice cubes of a size other than full size, and the shutter is opened when the ice grinder is not operated to produce ice cubes of full size. The auger may be configured to enable discharge of a piece of ice every time the auger is rotated by an angle defined by a gap between the transfer blades. The auger assembly may be configured to engage the ice maker and to receive ice from the ice maker in cubes of full and partial sizes, wherein a cube of full size is defined by a space within an individual compartment of an ice cube tray in the ice making device.

In another aspect, a refrigerating machine includes a refrigerating machine case; an ice-making unit included in the refrigerating machine case and configured to make ice; the auger in an ice bin with one or more of the attributes described above disposed inside the refrigerating machine case so as to discharge ice to the outside of the refrigerating machine case; a selection unit disposed outside the refrigerating machine case so as to allow a user to select an amount of ice required; and a control unit electrically connected between the auger in the ice bin and the selection unit to operate the auger in the ice bin according to a selection made by the selection unit.

Implementations of this aspect may include one or more of the following features. For example, the control unit may be configured to translate the amount of ice selected by the user into a rotation angle required by the auger provided in the auger in the ice bin.

DETAILED DESCRIPTION

Description will now be given in detail of the auger in an ice bin, examples of which are illustrated in the accompanying drawings.

Figure 1:
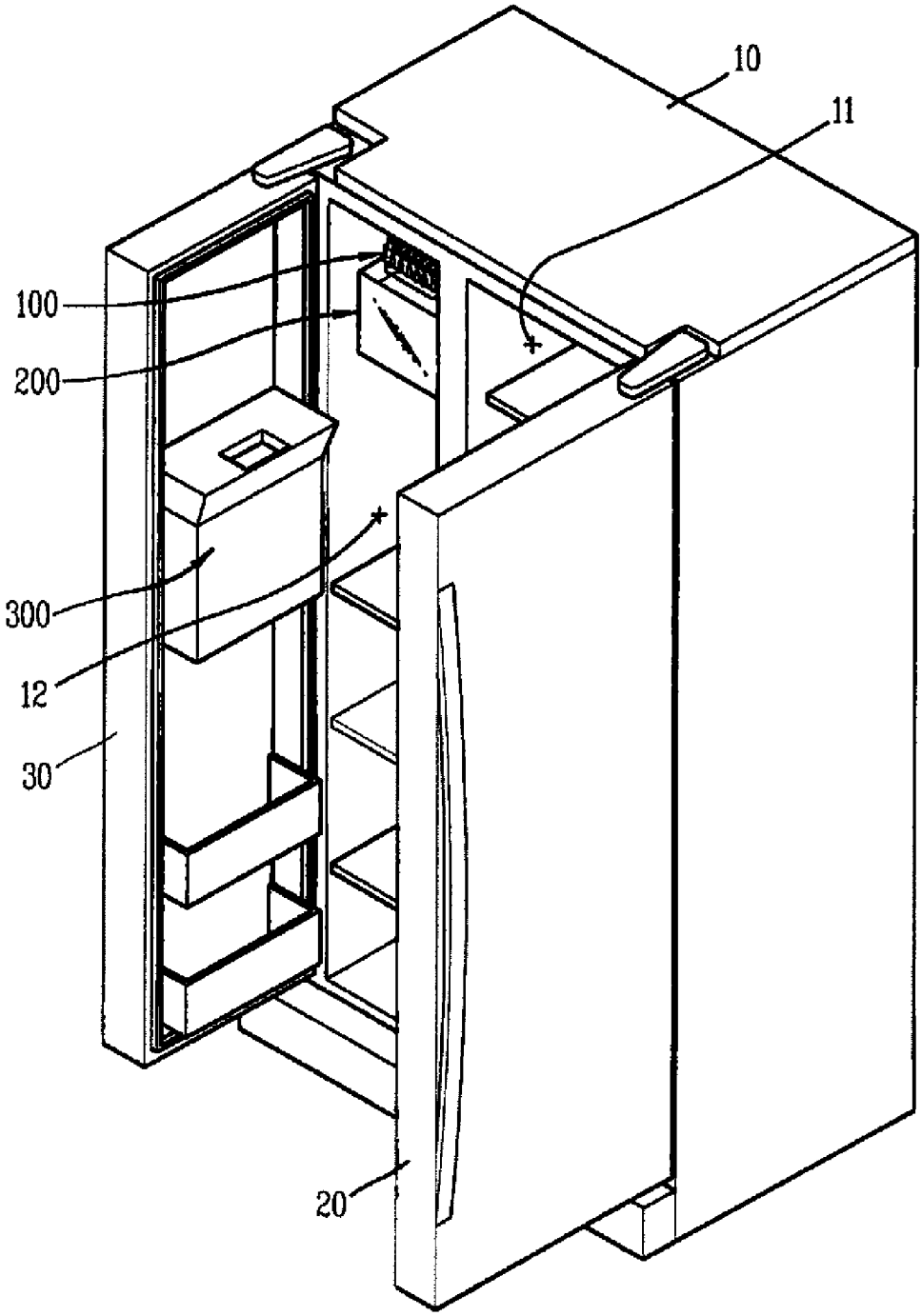
FIG. 1 is a perspective view showing a refrigerator.

As shown in FIG. 1, a refrigerator to which an auger in an ice bin is applied includes a refrigerator main body 10, a refrigerator door 20 that may be opened or closed to expose or restrict access to a refrigerating chamber 11 of the refrigerator main body 10, and a freezer door 30 for opening/closing a freezing chamber 12 of the refrigerator main body 10. There are further provided an ice-making machine 100 disposed at an inner side of the freezing chamber 12 for making ice, an ice bin 200 disposed below the ice-making machine 100, an auger in the ice bin 200 for storing ice made by the ice-making machine 100, and an ice dispenser 300 disposed outside the freezer door 30 for dispensing ice stored in the ice bin 200 according to a user's need.

Figure 2:
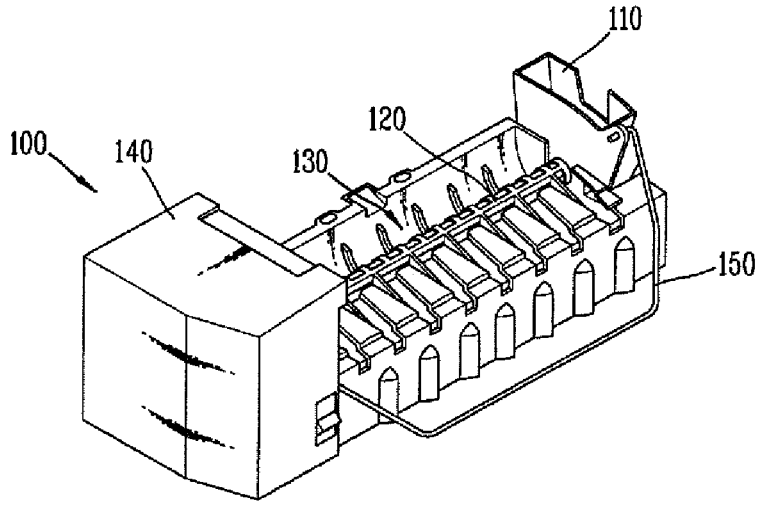
FIG. 2 is a perspective view showing an ice-making machine applied to the refrigerator.

As shown in FIG. 2, the ice-making machine 100 is configured to have a water supply unit 110 for supplying water from a source outside of the refrigerator, an ice-making chamber 120 for making ice by using water supplied from the water supply unit 110, an ejector 130 for separating ice made by the ice-making chamber 120, and a control box 140 for mounting many components therewithin so as to rotate the ejector 130. A mount unit (not shown) for mounting the ice-making machine 100 inside the refrigerator is provided at a rear direction of the ice-making chamber 120, and an ice level sensing lever 150 is disposed at a front direction of the ice-making chamber 120 to check that the ice-making machine 100 stops operating when the ice bin 200 is fully filled with ice pieces.

Figure 3:
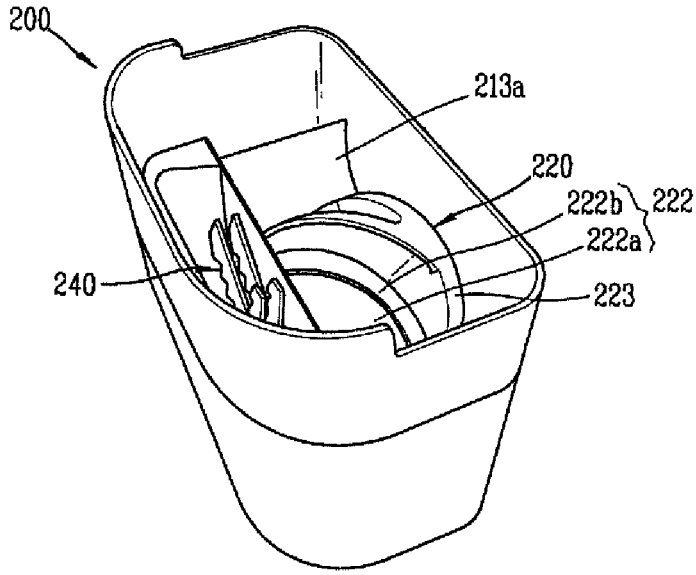
FIG. 3 is a perspective view showing an outer appearance of an ice bin applied to the refrigerator.
Figure 4:
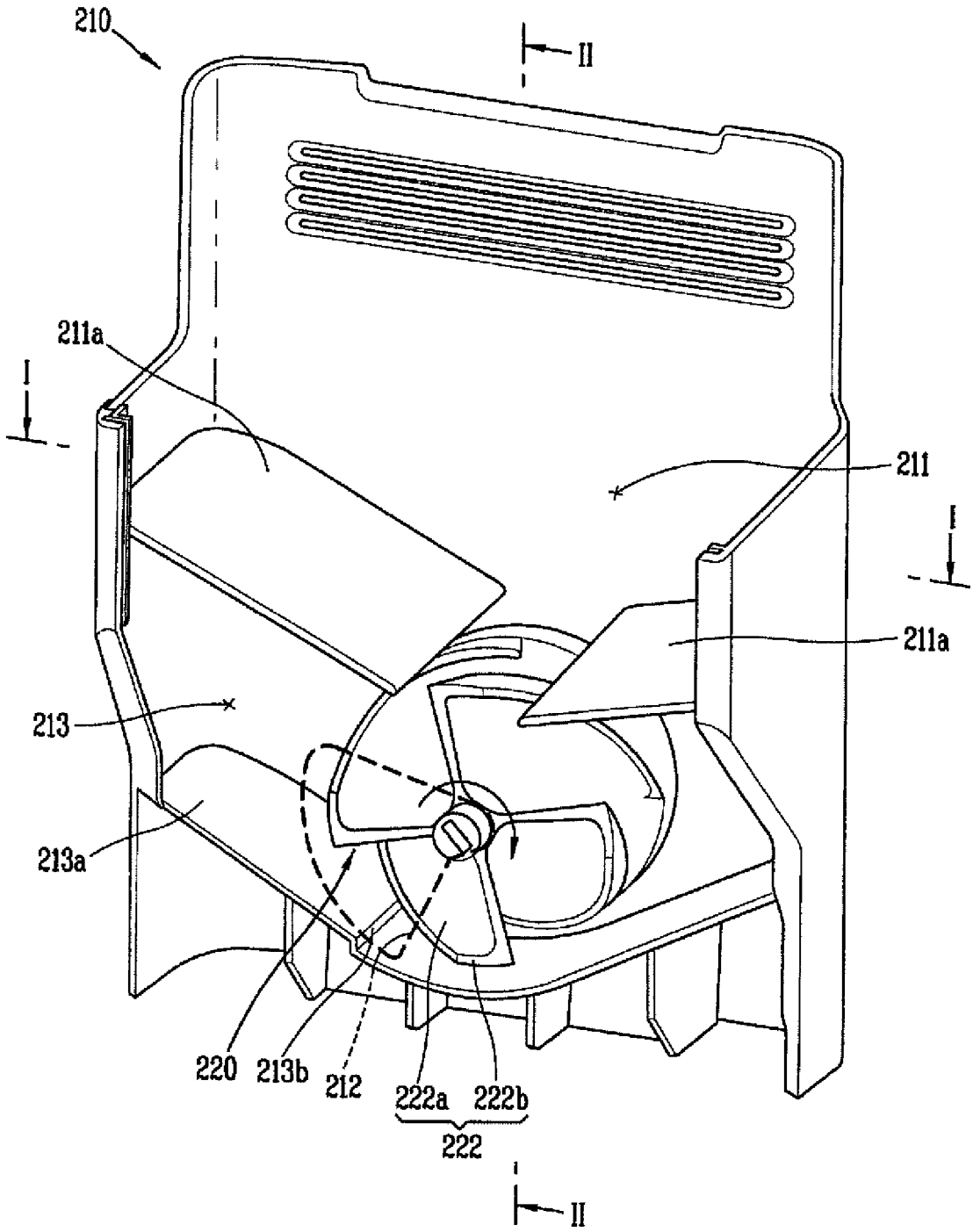
FIG. 4 is a perspective view showing an inside, except a grinder, of the ice bin of FIG. 3.
Figure 5:
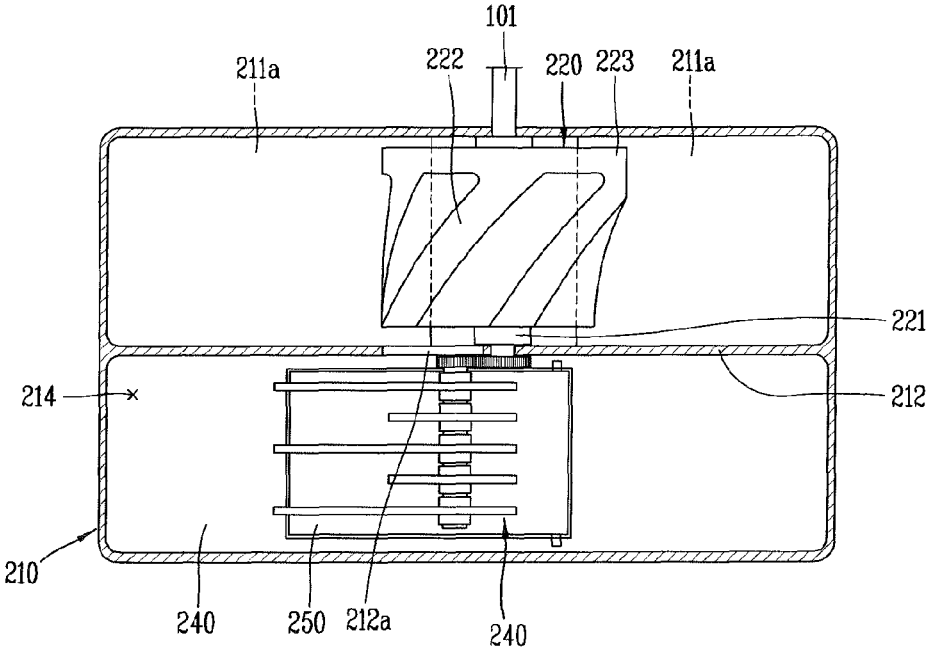
FIG. 5 is a cross-sectional view taken along line of 'I-I of FIG. 4.

As shown in FIGS. 3 and 4, the ice bin 200 is provided with a casing 210 having a certain inner space, a motor (not shown) disposed at one side of the casing 210 to generate a rotation force, and an auger 220 coupled to a rotation shaft 101 of the motor to transfer ice pieces one by one.

Figure 6:
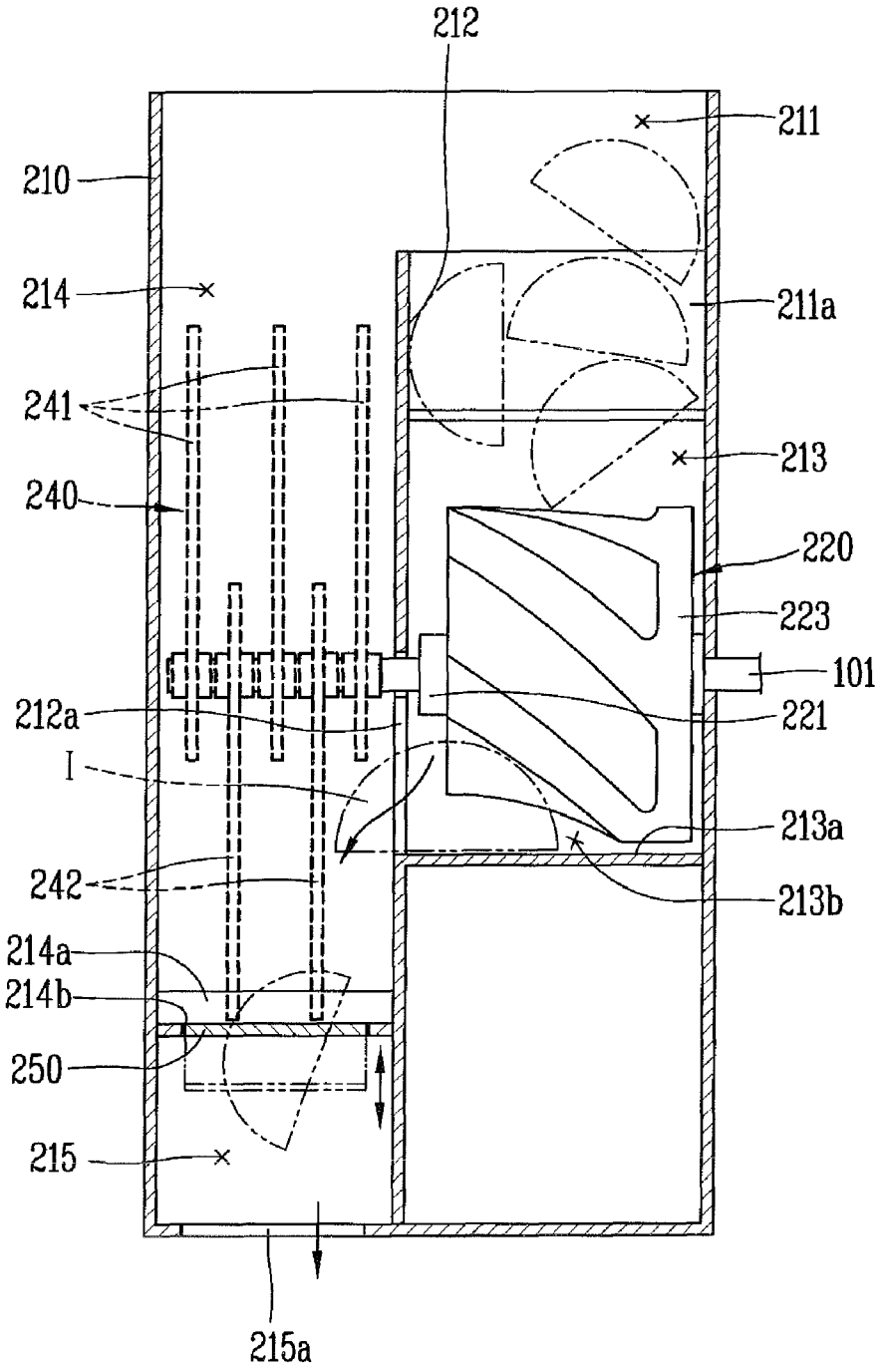
FIG. 6 is a cross-sectional view taken along line of 'II-II' having the grinder of FIG. 4.

As shown in FIGS. 4 and 6, an ice storage chamber 211 is disposed at an upper side of the casing 210 so as to store ice transferred from the ice-making machine 100. A partition wall 212 having a communication hole 212*a* is disposed in the casing 210. And, a transfer chamber 213 in which the auger 220 is mounted is disposed at one side of the partition wall 212. Further, first guides 211*a* positioned between the ice storage chamber 211 and the transfer chamber 213 may be downwardly inclined toward a central direction from each surface of both partition walls of the ice storage chamber 211 so as to smoothly direct ice to the transfer chamber 213. A second guide 213*a* may be curvedly formed on a bottom of the transfer chamber 213 such that the auger 220 can be smoothly rotated. An ice guide unit 213*b* for stopping ice may be formed to have a step on an upper surface of the second guide 213*a* such that the ice transferred by the auger 220 can be smoothly directed to the communication hole 212*a*.

A grind chamber 214 is disposed at another side of the partition wall 212 to mount an ice grinder 240, as will be described later. A discharge space 215 having a discharge opening 215*a* on a bottom surface thereof is disposed at a lower portion of the grind chamber 214. A third guide 214*a* is mounted between the grind chamber 214 and the discharge space 215. A through-hole 214*b* is positioned at the third guide 214*a* so as to enable communications between the grind chamber 214 and the discharge space 215. A shutter 250, which will be described later, is rotatably mounted at the through-hole 214*b*.

Both inner surfaces of the casing 210 in a width direction may be formed to have a width enough to nearly contact both side surfaces of the auger 220 in a lengthwise direction so as to prevent ice from falling to other spaces or from being trapped between both ends of the auger 220 and the casing 210. The communication hole 212*a* of the casing 210 may be formed to have a shape that is consistent with or almost the same shape as a largest space formed between the transfer blades 222 of the auger 220 such that the ice pieces transferred by being stored by the auger 220 can be individually discharged.

Figure 7:
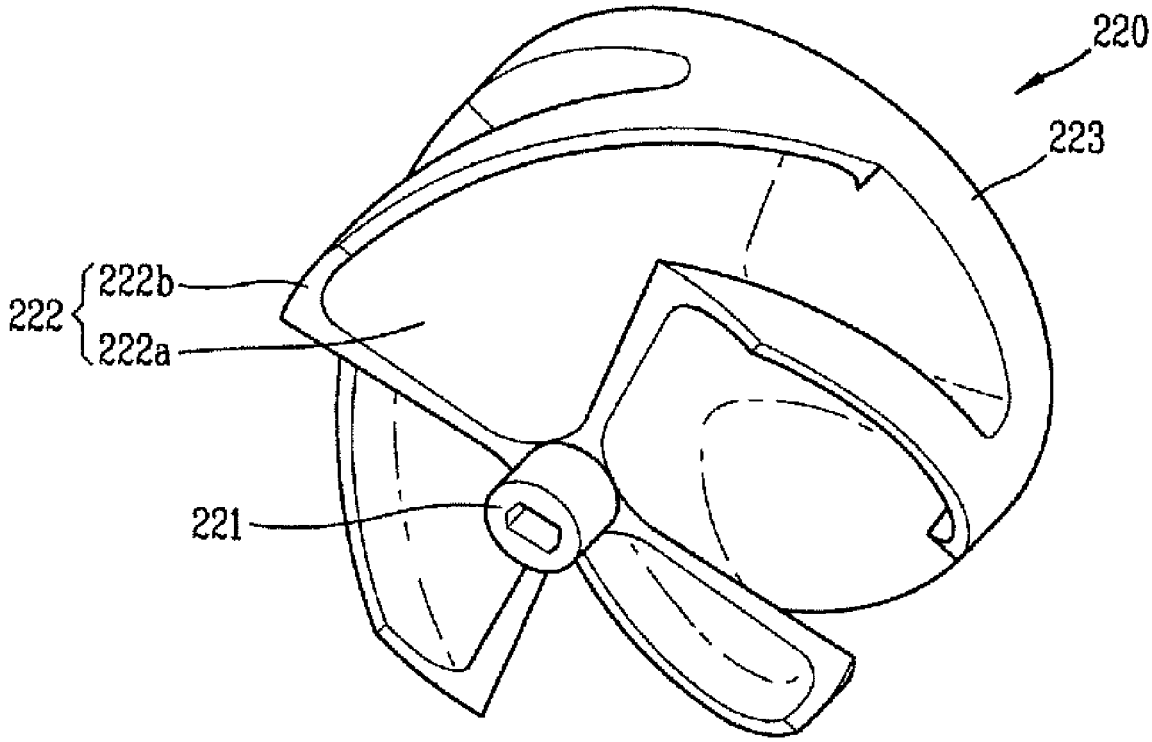
FIG. 7 is a perspective view showing an auger in the ice bin in FIG. 3.

As shown in FIG. 7, the auger 220 is configured to have a shaft portion 221 coupled to the rotation shaft 101 of the motor disposed at a rear direction of the casing 210, and a plurality of transfer blades 222 each spirally protruding from an outer circumferential surface of the shaft portion 221 in a circumferential direction with a certain distance therebetween so as to guide ice. Each transfer blade 222 is provided with a guide portion 222*a* protruding in a radial direction and spirally formed in a shaft direction so as to guide ice, and a receiving portion 222*b* bent from an outer edge of the guide portion 222*a* in a circumferential direction for individually storing ice pieces and stably transferring the ice pieces. The auger 220 may be configured to support the transfer blades 222 by a closed structure that end portions of the transfer blades 222 corresponding to an opposite side of the communication hole of the casing 210 are connected to each other by a disk-shaped reinforcing portion 223.

In one implementation the gap between the transfer blades 222 is formed to be almost the same as a size of individual ice pieces stored in the ice storage chamber 211 of the casing 210 such that the individual ice pieces can be disposed in each space between the transfer blades 222. And, the auger 220 may be made of a flexible material so as to prevent the ice pieces from being crushed during storage or transfer of the ice pieces.

In one implementation, the auger 220 is configured to discharge a piece of ice every time when the auger 220 is rotated by as much as the gap between the transfer blades 222. For instance, as shown in FIG. 7, if 4 transfer blades 222 are formed to be spaced with an approximately 90 degrees interval from each other, a piece of ice can be discharged every time when the auger 220 is rotated by 90 degrees (i.e., by ¼). Here, if a user uses the selection unit provided in the ice dispenser 300 to select the number of ice pieces, the control unit (not shown) having received the selection signal determines a rotation angle of the motor operating the auger 220 and then discharges ice pieces by as much as the numbers selected. The control unit may be configured that if, as shown in FIG. 7, the transfer blades 222 are disposed by 90 degrees interval and the user selects 3 pieces of ice, the auger 220 is rotated by only 270 degrees and then is stopped after sequentially discharging 3 pieces of ice.

Meanwhile, the grind chamber 214 having the through-hole 214*b* on the bottom surface thereof so as to discharge ice is further provided outside the communication hole 212*a* of the casing 210. An ice grinder 240 may further be provided in the grind chamber 214 to discharge ice or to grind ice for discharge. And, a shutter 250 may be disposed at the through-hole 214*b* to select the size of ice discharged.

Figure 8:
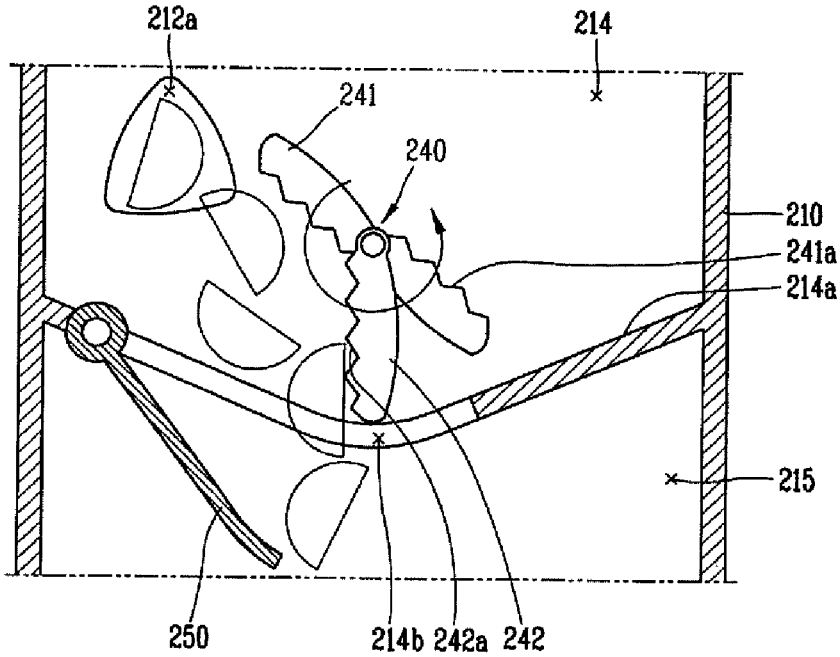
FIGS. 8 and 9 are schematic views respectively showing an operational state of a grinder applied to the ice bin.
Figure 9:
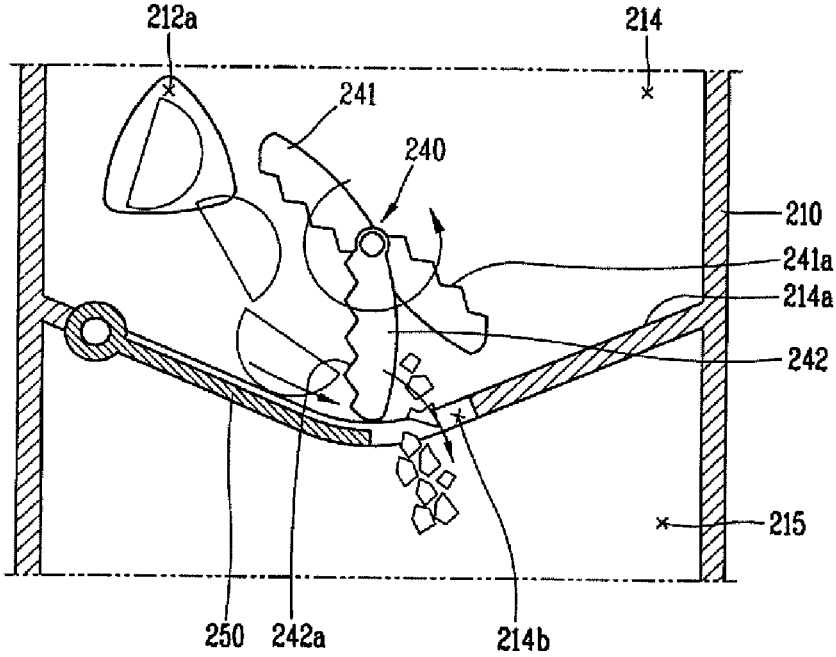

As shown in FIGS. 8 and 9, the ice grinder 240 may be operated by the same motor as the auger 220 by using a gear coupling, but, in some cases, may be operated with a separate motor for grinding. And, the ice grinder 240 includes a plurality of rotary blades 241 rotating by being coupled to the motor for rotating the auger or the motor for grinding, and a plurality of fixed blades 242 disposed between the plurality of rotary blades 241. The ice grinder 240 is configured to grind ice by disposing the ice between the rotary blades 241 and the fixed blades 242.

The rotary blades 241, as described above, may be rotated by coupling to the same shaft as the auger 220, or may be rotated by a separate motor shaft. And, a rotary knife blade 241*a* curved in a longitudinal direction of the rotary blades 241 is formed on a side surface of the rotary blades 241 in a rotation direction so as to transfer or grind ice being transferred by the transfer blades 222 of the auger 220.

The fixed blades 242 are fixed above the discharge space 215, and a fixed knife blade 242*a* curved in a longitudinal direction of the fixed blades 242 is formed on a side surface corresponding to and facing the rotary knife blade 241*a* of the rotary blades 241 so as to grind ice together with the rotary knife blade 241*a* of the rotary blades 241.

As shown in FIGS. 8 and 9, the shutter 250 is curvedly formed with a certain length in a radius of rotation of the rotary blades 241. One side of the rotary blades 241 is hinge-coupled to an edge of the through-hole 214*b* such that the shutter 250 can be rotated with respect to the surface of the third guide 214*a* of the casing 210. And, the shutter 250 is selectively opened by the rotation of the rotary blades 241. Further, a manipulation lever (not shown) for upwardly supporting the shutter 250 is disposed at a lower end surface of the shutter 250 so as to maintain the state that the shutter 250 has closed the discharge opening 215*a*. The manipulation lever is pivotably coupled to the casing 210 so as to perform an opening/closing operation of the shutter 250.

In one implementation, the auger in the ice bin is operated as follows:

Ice pieces made in the ice-making chamber 120 of the ice-making machine 100 are transferred and piled up, by the ejector 130, to the ice storage chamber 211 disposed at the upper side of the casing 210 of the ice bin 200. The ice pieces piled up in the ice storage chamber 211 remain piled up until before the user selects an option to discharge ice from the dispenser 300. Here, through the ice level sensing lever 150 disposed in the ice-making machine 100, a proper amount of ice should always be piled up in the ice storage chamber 211.

Figure 10:
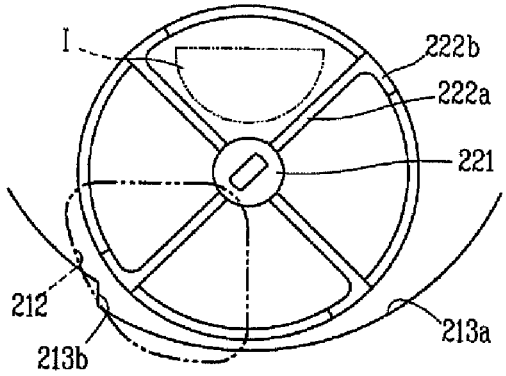
FIGS. 10 through 12 are operational diagrams each showing the auger in the ice bin.
Figure 11:
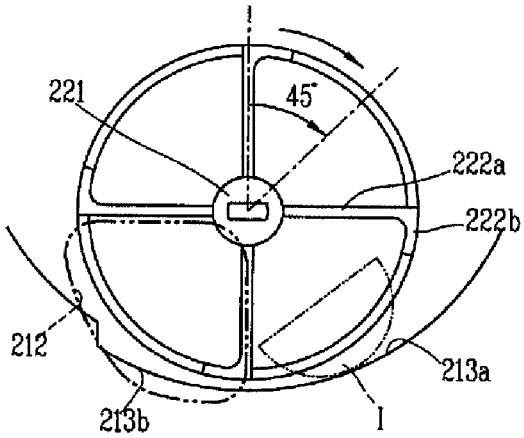

If the user selects the option to discharge ice from the ice dispenser 300, the motor of the ice bin 200 operates and the auger 220, as shown in FIGS. 10 and 11, is thereby rotated in a clockwise direction in the drawing. Accordingly, the ice pieces piled up in the ice storage chamber 211 of the casing 210 are introduced into each space between the transfer blades 222 of the auger 220. Here, the ice pieces piled up in the ice storage chamber 211 may be stuck together, thereby causing a plurality of ice pieces to be simultaneously introduced into each space between the transfer blades 222 of the auger 220. However, the space formed between the transfer blades 222 of the auger 220 is formed to have an area of a piece of ice, and the receiving portion 222*b* is bent from the edge of the guide portion 222*a* of the transfer blades 222 in a circumferential direction, thereby preventing the plurality of ice pieces from simultaneously being introduced into the auger 220.

Figure 12:
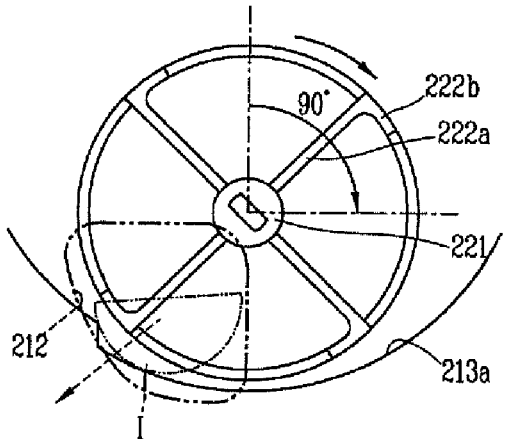

As shown in FIGS. 11 and 12, the auger 220 is rotated while receiving ice in the space between the transfer blades 222, and transfers ice from upward to downward directions. During this process, the ice is guided along the guide portion 222*a* and the receiving portion 222*b* of the auger 220 in a rotation direction, and then is stopped by the ice guide unit 213*b* formed at the second guide 213*a* of the casing 210. Then, the ice is pushed by the spiral-shaped transfer blades 222 (i.e., the guide portion 222*a* and the receiving portion 222*b* of the transfer blades 222) and then is guided in a shaft direction, and is transferred to the grind chamber 214 of the casing 210 through the communication hole 212*a* disposed at a rear direction of the ice guide unit 213*b* in a shaft direction. Here, in one implementation, one or two pieces of ice are received in the auger 220 for transfer. However, although many pieces of ice are received in the auger 220 for transfer due to unexpected situations, the communication hole 212*a* is formed to have a width enough for approximately only one or two pieces of ice to be transferred, thereby preventing the plurality of ice pieces from simultaneously being transferred into the discharge space 215.

Thereafter, the ice transferred to the grind chamber 214 may be directly guided to the discharge space 215 by the rotary blades 241 of the grinder 240 disposed in the grind chamber 214, or may be guided into the discharge space 215 by being grinded as ice pieces in the spaces between the rotary blades 241 and the fixed blades 242 of the grinder 240. That is, when the user selects an option to discharge ice pieces, instead of a block of ice, the shutter 250 is closed, and then a block of ice is grinded in the space between the rotary blades 241 and the fixed blades 242, and is thereby guided to a guide passage of the dispenser 300 through the discharge opening 215*a*.

Thus, since ice pieces made by the ice-making machine are individually separated and discharged from the auger of the ice bin made of the flexible material, the ice pieces can be discharged without being crushed as well as a great amount of ice can be prevented from simultaneously being discharged.

Meanwhile, the auger in the ice bin according to another implementation will be described.

Figure 13:
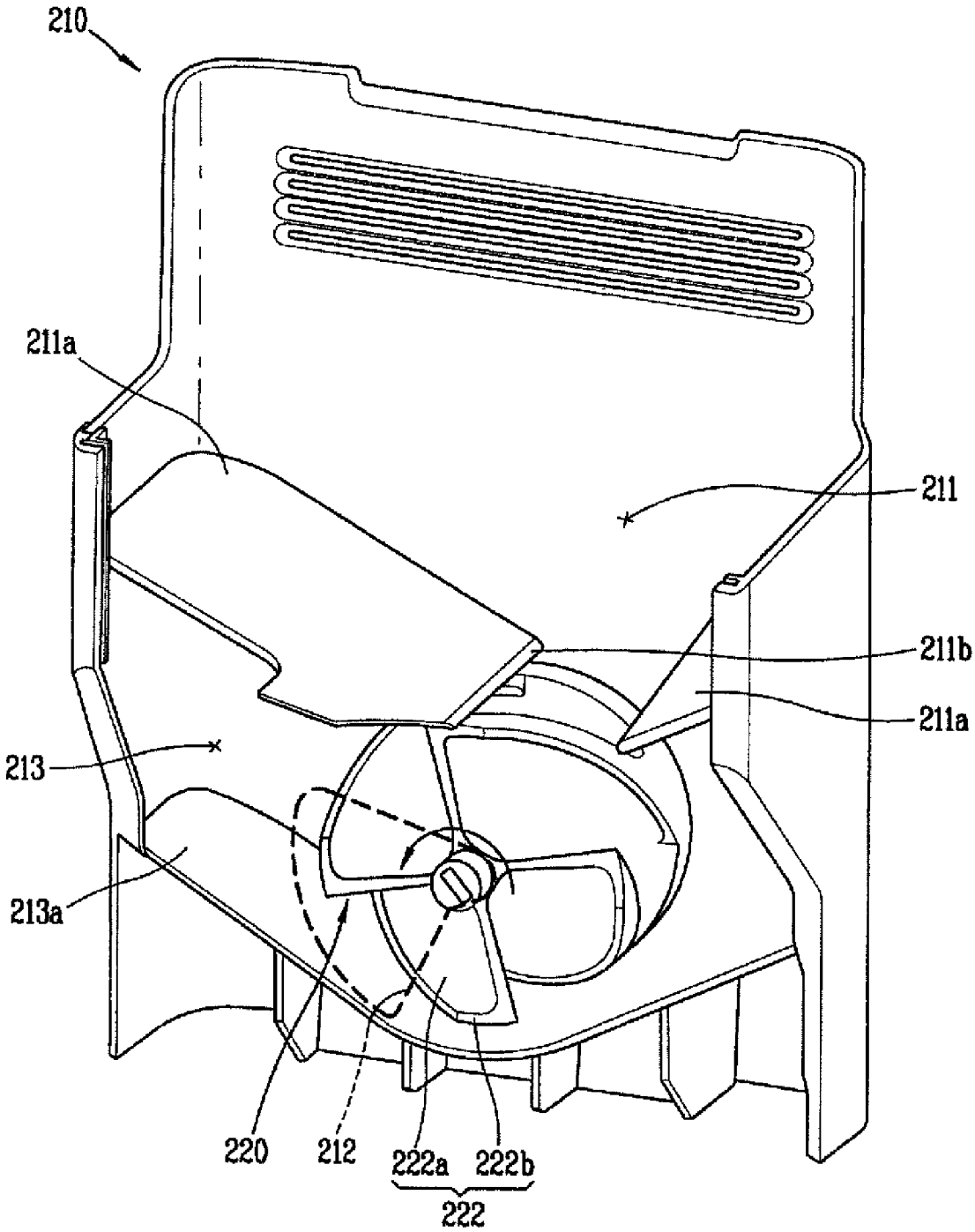
FIG. 13 is a perspective view showing another exemplary ice bin according to FIG. 3.

In the previous embodiment, the auger 220 is rotated while receiving ice, and pushes ice stopped by the ice guide unit 213*b* of the casing 210 to transfer to the discharge space 215. In this embodiment, however, as shown in FIG. 13, when the auger 220 is rotated while receiving ice, the ice is transferred to the discharge space 215 by being slidingly fallen from the transfer blades 222 of the auger 220.

Such a basic configuration is almost the same as that in the previous embodiment, and detailed explanations therefor are omitted. Here, in this embodiment, the motor is rotated in a counter-clockwise direction, which is an opposite direction to the previous embodiment. That is, the motor is rotated toward an opened side of the transfer blades 222 of the auger 220. A communication hole 212*a* is disposed at the central portion of the rear surface of the casing 210 facing the opened side of the transfer blades 222. While the ice disposed in each space between the transfer blades moves in a rotation direction of the auger 220, when it passes the communication hole 212*a*, the ice is slid in a free fall manner.

Here, a sharp ice cutting portion 211*b* may be disposed at the end portion of the first guide 211*a* between the ice storage chamber 211 and the transfer chamber 213 of the casing 210 such that, when the auger 220 is rotated, the ice disposed in the auger 200 can be partially cut and individually transferred.

The auger in the ice bin is configured to rotate an auger having spiral-shaped transfer blades and to dispose ice in each space between the transfer blades of the auger so as to transfer ice. Thus, a fixed amount of ice or an amount of ice selected by the user can always be discharged. Further, the auger is made of the flexible material, thereby preventing ice from being crushed during the transfer process.

Even though the present embodiment describes the auger in the ice bin applied to the refrigerator, the auger in the ice bin may also be applied to the water purifier and other refrigerating machines, as mentioned above. Also, the auger in the ice bin may be disposed together with the ice-making machine or the dispenser, but in some cases, it may be independently disposed.

What is claimed is:

1. An auger assembly in an ice bin of an ice maker having an ice making device configured to generate ice cubes of a full size, comprising:

a casing defining an ice storage chamber at an opened upper surface thereof, a discharge opening at a lower surface thereof so as to discharge ice, and a communication hole disposed at a side surface of a transfer chamber and positioned between the ice storage chamber and the discharge opening so as to pass ice;

a rotational shaft configured to transfer a rotational force; and an auger rotatably mounted inside the casing and configured to rotate based on the rotational force transferred by the rotational shaft, wherein the augur comprises:

a shaft portion coupled to the rotational shaft so as to receive the rotational force;

at least two spiral-shaped transfer blades each spirally protruding from an outer circumferential surface of the shaft portion in a circumferential direction, two adjacent of the spiral-shaped transfer blades being separated from each other and shaped to provide a space there between that is sized to accommodate at least an ice cube of full size from within the ice storage chamber, the spiral-shaped transfer blades being configured to rotate with the shaft portion so as to transfer, based on blade rotation, the ice cube through the communication hole of the casing; and a disk-shaped reinforcing portion connected to an end of each of the spiral-shaped transfer blades and the shaft portion of the auger.

2. The auger assembly of claim 1, further comprising an ice cutting portion disposed between the ice storage chamber and the transfer chamber of the casing and configured to at least partially cut ice disposed within the auger when the auger is rotated.

3. The auger assembly of claim 1, further comprising an ice guide unit positioned closer to the communication hole than the ice chamber and having a step structure that interfaces ice cubes that are accommodated and being moved by the spiral-shaped transfer blades, to inhibit rotational movement of those ice cubes so as to guide the ice cubes disposed in the auger to the communication hole.

4. The auger assembly of claim 1, wherein the communication hole of the casing has a shape that is consistent with a shape of the space defined between the transfer blades of the auger when positioned to accommodate an ice cube of full size.

5. The auger assembly of claim 1, wherein the auger includes a flexible material so as to prevent ice from being crushed.

6. The auger assembly of claim 1, wherein the transfer blades include a receiving portion extending circumferentially at an angle from an outer edge of the transfer blades in a circumferential direction.

7. The auger assembly of claim 1, wherein the space defined between the transfer blades is consistent in size with a size of an individual ice cube of full size that is stored in the ice storage chamber.

8. The auger assembly of claim 1, further comprising a grind chamber having a through-hole at a lower surface thereof positioned outside the communication hole of the casing so as to guide ice to the discharge opening.

9. The auger assembly of claim 8, wherein an ice grinder is included in the grind chamber and configured to discharge ice or to grind ice for discharge.

10. The auger assembly of claim 9, wherein the ice grinder includes rotary blades and fixed blades, the ice grinder being configured to grind ice that is disposing between the rotary blades and the fixed blades.

11. The auger assembly of claim 10, wherein the rotary blades and the fixed blades are positioned within the ice grinder in an alternating manner.

12. The auger assembly of claim 8, further comprising a shutter that is positioned at a through-hole and adjustably configured to control the size of ice discharged through the through-hole.

13. The auger assembly of claim 12, wherein the shutter is configured with a first end that is fixed relative to a location of the ice grinder and a second end that moves relative to the first end to effect selection of size for ice cubes discharged as between at least ice cubes of full size and ice cubes of a size other than full size, the shutter being oriented relative to the ice grinder, whereby the shutter is at least partially closed when the ice grinder is operated to produce ice cubes of a size other than full size, and the shutter is opened when the ice grinder is not operated to produce ice cubes of full size.

14. The auger assembly of claim 1, wherein the auger is configured to enable discharge of a piece of ice every time the auger is rotated by an angle defined by a gap between the transfer blades.

15. The auger assembly of claim 2, wherein the auger assembly is configured to communicate with the ice maker and to receive ice from the ice maker in cubes of full and partial sizes, wherein a cube of full size is defined by a space within an individual compartment of an ice cube tray in the ice making device.

16. A refrigerating machine, comprising:

a refrigerating machine case;

an ice-making unit included in the refrigerating machine case and configured to make ice;

the auger in the ice bin of claim 5 disposed inside the refrigerating machine case so as to discharge ice to the outside of the refrigerating machine case;

a selection unit disposed outside the refrigerating machine case so as to allow a user to select an amount of ice required; and a control unit electrically connected between the auger in the ice bin and the selection unit to operate the auger in the ice bin according to a selection made by the selection unit.

17. The refrigerating machine of claim 16, wherein the control unit is configured to translate the amount of ice selected by the user into a rotation angle required by the auger provided in the auger in the ice bin.

18. The auger assembly of claim 1, wherein the at least two spiral-shaped transfer blades are configured to include:

a guide portion protruding in a radial direction and spirally formed in a shaft direction so as to guide ice, and a receiving portion bent from an outer edge of the guide portion in a circumferential direction for individually storing ice pieces and stably transferring the ice pieces.

19. The auger assembly of claim 1, wherein the disk shaped reinforcing portion is connected to a face of each transfer blade that is opposite the communication hole.

* * * * *